US009476015B2

(12) United States Patent
Cesari

(10) Patent No.: US 9,476,015 B2
(45) Date of Patent: Oct. 25, 2016

(54) NON-TOXIC HAND CLEANER COMPRISING A TERNARY SOLVENT MIXTURE

(71) Applicant: Richard Adam Cesari, Dallas, TX (US)

(72) Inventor: Richard Adam Cesari, Dallas, TX (US)

( * ) Notice: Subject to any disclaimer, the term of this patent is extended or adjusted under 35 U.S.C. 154(b) by 0 days.

(21) Appl. No.: 13/953,607

(22) Filed: Jul. 29, 2013

(65) Prior Publication Data

US 2015/0031595 A1 Jan. 29, 2015

(51) Int. Cl.

| | |
|---|---|
| ***C11D 1/83*** | (2006.01) |
| ***C11D 3/44*** | (2006.01) |
| ***C11D 7/50*** | (2006.01) |

(52) U.S. Cl.

CPC ..... *C11D 7/5022* (2013.01)

(58) Field of Classification Search

USPC ..... 510/130, 131, 137, 138, 139, 155, 156, 510/158, 159, 242, 251, 253, 268, 417, 422, 510/426, 427, 432, 485, 507

See application file for complete search history.

(56) References Cited

U.S. PATENT DOCUMENTS

| | | | | |
|---|---|---|---|---|
| 4,495,079 | A | 1/1985 | Good | |
| 5,977,039 | A | 11/1999 | Gordon et al. | |
| 6,074,655 | A | 6/2000 | Fowler et al. | |
| 6,376,438 | B1 | 4/2002 | Rosenberger et al. | |
| 6,884,763 | B2 | 4/2005 | Willard et al. | |
| 8,283,299 | B2 | 10/2012 | Allef et al. | |
| 2006/0223728 | A1* | 10/2006 | Tokunaga | 510/124 |
| 2006/0264505 | A1* | 11/2006 | Popp et al. | 514/547 |
| 2010/0210499 | A1 | 8/2010 | Allef et al. | |
| 2012/0039835 | A1* | 2/2012 | Terazaki | 424/70.12 |
| 2014/0147395 | A1* | 5/2014 | Rieth et al. | 424/49 |

FOREIGN PATENT DOCUMENTS

| | | |
|---|---|---|
| DE | WO 9725974 | 7/1997 |
| EP | WO 9922712 | 5/1999 |

* cited by examiner

*Primary Examiner* — Charles Boyer
(74) *Attorney, Agent, or Firm* — Ariel Bentolila

(57) ABSTRACT

A cleaning composition comprises between about 10% to about 50% of at least one organic solvent comprising vegetable oil. The composition further comprises between about 2% to about 20% of at least one co-solvent. The composition further comprises at least one water-in-oil emulsifier and non-ionic surfactant. The composition also comprises at least one anionic surfactant and between about 20% to about 60% of water.

14 Claims, 4 Drawing Sheets

Formulation 3

| | | |
|---|---|---|
| 206 | water | 37 |
| 202 | vegetable oil | 37 |
| 204 | propylene carbonate | 7 |
| 208 | water in oil emulsifier | 8 |
| 210 | guar gum | 2 |
| | anionic surfactant | 2 |
| 212 | lauric acid | 1.5 |
| | walnut shell | 3 |
| 214 | denatonium | 1 |
| 216 | bentonite clay | 1.5 |

211

218

230

FIG. 2C

NON-TOXIC HAND CLEANER COMPRISING A TERNARY SOLVENT MIXTURE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to cleaning compositions. More particularly, the invention relates to a cleaning composition that combines co-solvents and emulsifiers with vegetable oil to remove residue.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that cleaning agents are substances, usually liquids, that are used to remove dirt, including dust, stains, bad smells, and clutter on surfaces. The purposes of cleaning agents includes health, beauty, absence of offensive odor, avoidance of shame, and avoidance of spreading of dirt and contaminants to oneself and others. Some cleaning agents can kill bacteria and clean at the same time.

Typically, a solvent is a substance that dissolves a solute, such as a chemically different liquid, solid or gas, resulting in a solution. A solvent is usually a liquid but can also be a solid or a gas.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 2A, 2B and 2C illustrate formulation tables of an exemplary cleaning composition, in accordance with an embodiment of the present invention, where FIG. 2A illustrates a first cleaning composition formulation, FIG. 2B illustrates a second cleaning composition formulation, and FIG. 2C illustrates a third cleaning composition formulation.

Figure 1:
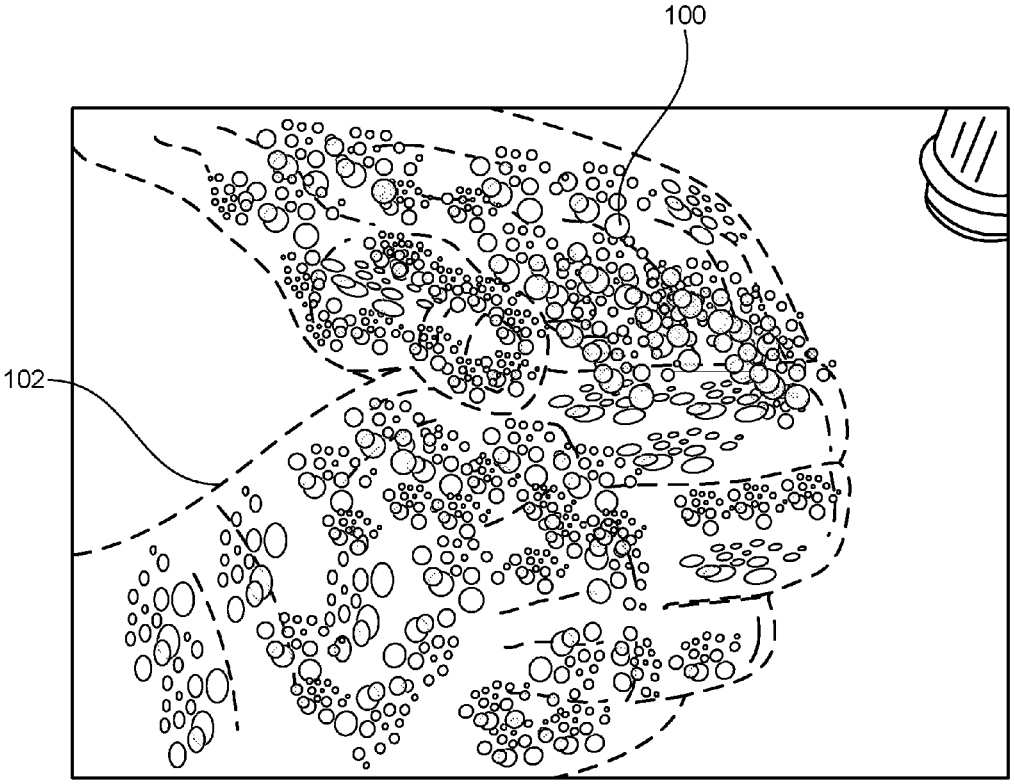
FIG. 1 illustrates a detailed perspective view of an exemplary cleaning composition removing residue from an exemplary surface, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of cleaning compositions that may be provided by preferred embodiments of the present invention. In one embodiment of the present invention, the cleaning composition may provide a multi-purpose cleaning composition that may help remove residue, including, without limitation, oil, tar, paint, super glue, epoxy, paint, fats, grease, oils, lubricants, metal dust, graphite, and carbon black from a surface. In some embodiments, the cleaning composition may include various solvents and chemical agents efficacious for composing a non-toxic, environmentally safe, and inexpensive to manufacture cleaning agent.

In one embodiment of the present invention, the cleaning composition may combine co-solvents and emulsifiers with an organic solvent, such as, but not limited to, vegetable oil, to help remove the residue. The co-solvents may produce enhanced cleaning functions when combined at a lower percentage, including, without limitation, about 3%-7%, and then recombined with the vegetable oil. Those skilled in the art, in light of the present teachings, will recognize that a single co-solvent at about 30% composition of the cleaning composition may not produce the same cleaning capacity as the combination of co-solvents at the lower percentages and the vegetable oil. The emulsifiers may serve to stabilize and mix a plurality of solvents and chemical agents for manufacturing the cleaning agent. Additional ancillary chemical agents may allow for cost saving and safety features. In some embodiments organic solvents comprise the dibasic esters such as, but not limited to, di-methyl adipate, di-methyl succinate and di-methyl glutarate or any inexpensive organic solvents that behave as emollients (skin softeners).

In one embodiment of the present invention, the cleaning composition may provide enhanced cleaning capacity due to the combinative effects of various solvents and chemical agents, including, without limitation, combining a vegetable oil with small concentrations of co-solvents; combining carbonate esters with water; combining a non-ionic surfactant and an anionic surfactant; combining lipohilic solvents with solvents that are miscible in both oil and water, including, without limitation di-propylene glycol monomethyl ether, ethyl lactate, gamma butyrolactone, methyl ethyl ketone, butenodiol; combining carbonate esters with glycolic methyl ethers; and combining carbonate esters with water in an emulsion. In some embodiments, engaging the cleaning composition with the surface to remove residue may further be enhanced by adding water.

In one embodiment of the present invention, the cleaning composition may include an organic solvent for helping to dissolve the residue. The organic solvent may include, without limitation, vegetable oil, palm oil, soybean oil, coconut oil, canola oil, and triglycerides. In some embodiments, the cleaning composition may further comprise at least one co-solvent, including, without limitation, propylene carbonate, di-methyl carbonate, ethyl carbonate, methyl-ethyl carbonate, butyrolactone, ethyl lactate, di-methyl adipate, methyl-ethyl ketone, butyrolactone, and butenodiol. Each co-solvent may form a synergy with other co-solvents and the vegetable oil to provide a cleaning agent that removes, not only grease, but epoxies, paints, and varnishes from a surface. The smaller quantities and concentrations required from the co-solvents may reduce costs and provide a more environmentally friendly cleaning composition. Furthermore, carbonate esters of methyl and ethyl alcohol in particular are very low in toxicity and are non-mutagenic.

In some embodiments, the cleaning composition may include at least one emulsifier, including, without limitation, dipropylene glycol methyl ether, di-propylene glycol, polysorbate 60, sorbitan stearate, polyglyceral oleate, lecithin, sorbitan monooleate, glyceryl monooleate, lanolin, octyldodecnnol, octoyldodecyl xyloside, peg-30 dipolyhydroxystearate, or any ehtoxylated fatty alcohol and lanolin. The emulsifier may include a water-in-oil type emulsifier, whereby the water disperses into an oil phase. In some embodiments, the water-in-oil emulsion may contain nycelles of water and water soluble components surrounded by lipophilic solvents and oil. The nycelles may allows for diluted solvents to form a concentrated film of lipophilic solvent on the surface for enhanced cleaning capabilities. Those skilled in the art, in light of the present teachings, will recognize that the emulsifier di-propylene glycol monomethyl ether may include a non-toxic carrier agent composed to amplify the solvent properties of the at least one co-solvent. Di-propylene glycol mono-methyl ether may also provide enhanced emusification and provide long term stability to the emulsion even when frozen and thawed by inhibiting the formation of large water crystals. Additional ancillary ingredients used to compose the cleaning composition may include a denaturant, including, without limitation, denatonium for providing a bitter taste to the composition, thereby helping to prevent accidental ingestion.

In one embodiment of the present invention, the cleaning composition may include a thickening agent for lowering the volatility and vapor pressure of the solvents. In this manner, the cleaning composition may be mixed at room temperature, thereby reducing manufacturing costs. A water phase thickening agent may include, without limitation, guar gum, carageenan gum, and xanthan gum. Those skilled in the art, in light of the present teachings, will recognize that thickening agents may require large quantities of heat during the shear mixing manufacturing process. The additional heat may add complexity and additional safety measures when working with volatile solvents. The guar gum and bentonite clay serve to help lower the volatility and vapor pressure of the solvents, thereby helping to negate the need for the heat during the manufacturing process. In some embodiments, an oil phase of the cleaning composition may be thickened with an oil phase thickening agent, such as bentonite clay. The cleaning composition may include bentonite clay for increasing viscosity of the organic solvent and the at least one co-solvent. Those skilled in the art, in light of the present teachings, will recognize that thickening agents may include a shear thinning property such that when used to gel the cleaning composition, the resulting gel composition may have a thixotropic property and may decrease in viscosity in the presence of shear forces and later gel in the absence of shear forces. In this manner, the cleaning composition may flow from a dispenser under force or blend easily into solution while shear mixing and gelling, thereby helping to simplify the mixing, dispensing, and pouring process during manufacture. In some embodiments, ammonium xylene sulfonate or other types of anionic detergent may be added as a dispersant and sudsing agent such that the mixture may be rinsed from the hands with water. In yet another embodiment, lauric acid may be added to the cleaning agent, serving as an anti-microbial agent, anti-oxidant, chelating agent and a PH balancing agent. An abrasive, such as walnut shells may be included for enhancing the cleaning process.

FIG. 1 illustrates a detailed perspective view of an exemplary cleaning composition removing residue from an exemplary surface, in accordance with an embodiment of the present invention. In the present invention, a cleaning composition 100 may provide a multi-purpose cleaning composition that may help remove residue, including, without limitation, oil, tar, paint, super glue, epoxy, cyanoacrylate adhesives, paint, fats, grease, oils, lubricants, metal dust, graphite, and carbon black from a surface 102. In some embodiments, the cleaning composition may remove exceptionally hard to remove residue such as, tar, epoxy, and cyanoacrylate adhesives from the surface with a combination of less concentrated solvents, whereby the synergy created between the various solvents may enhance the cleaning capability of the cleaning compound. The cleaning composition may include different compositions, including, without limitation, a gel, a liquid, a solid, and a gas emitting from an aerosol container. The surface may include, without limitation, skin, fabric, cotton, plastic, fiberglass, metal, and wood. In one embodiment of the present invention, the cleaning composition may provide enhanced cleaning capacity due to the combinative effects of various solvents and chemical agents, including, without limitation, combining the vegetable oil with small concentrations of the co-solvents; combining carbonate esters with water; combining a non-ionic surfactant and an anionic surfactant; combining lipohilic solvents with solvents that are miscible in both oil and water, including, without limitation dipropylene glycol monomethyl ether, ethyl lactate, gamma butyrolactone, methyl ethyl ketone, butenodiol; combining carbonate esters with glycolic methyl ethers; and combining carbonate esters with water in an emulsion. In some embodiments, engaging the cleaning composition with the surface to remove residue may further be enhanced by adding water.

Figure 2A:
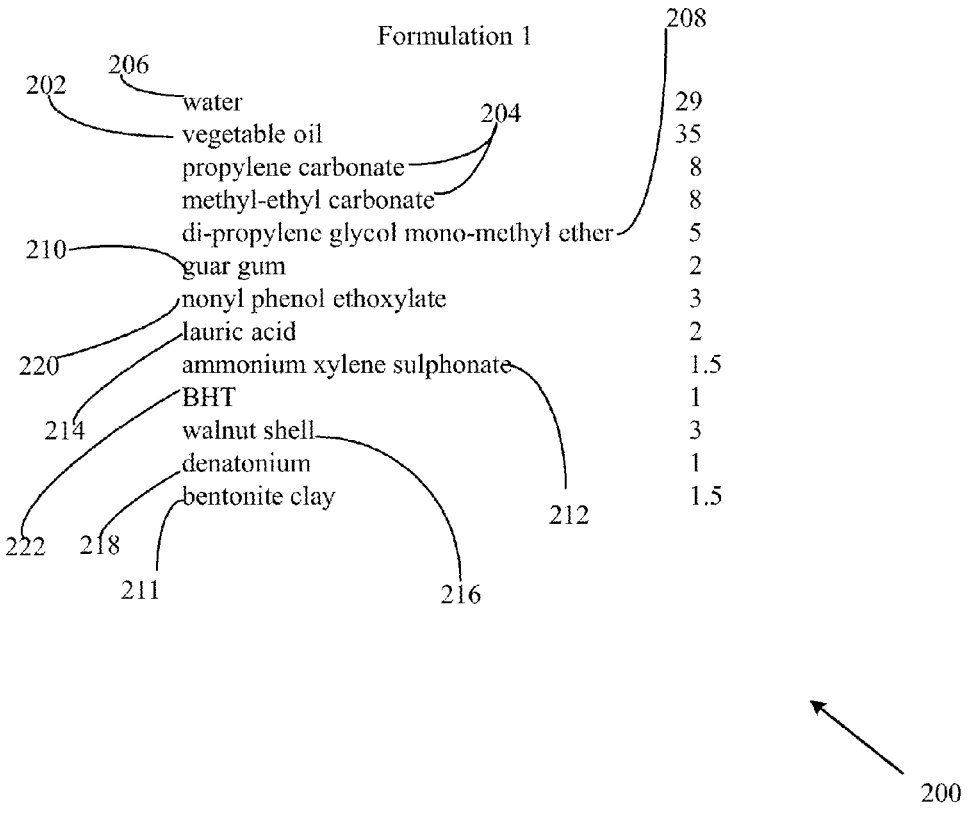
Figure 2B:
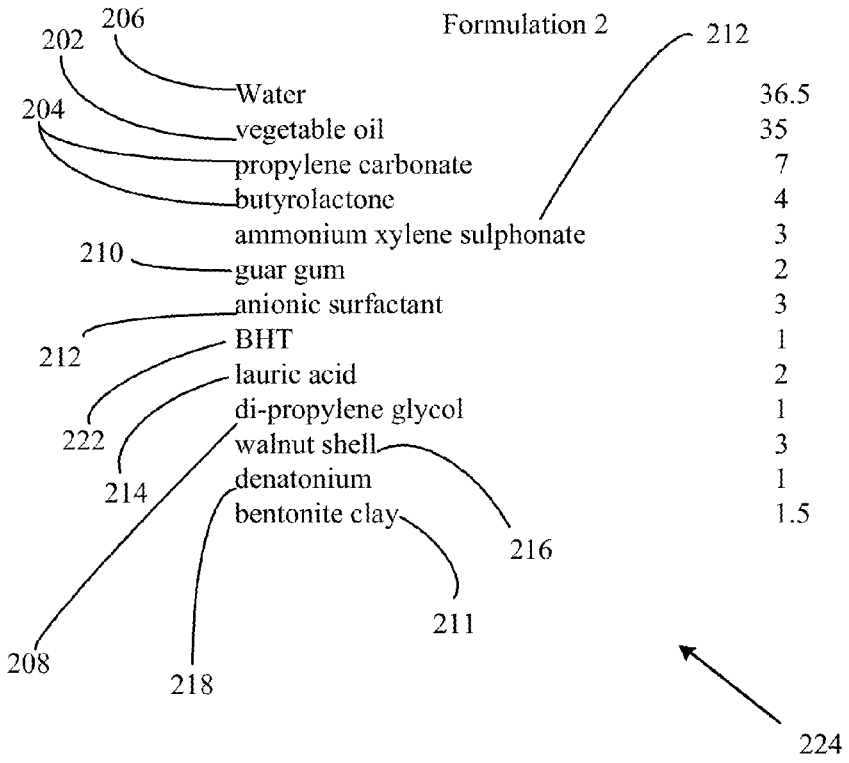

FIGS. 2A, 2B and 2C illustrate formulation tables of an exemplary cleaning composition, in accordance with an embodiment of the present invention, where FIG. 2A illustrates a first cleaning composition formulation, FIG. 2B illustrates a second cleaning composition formulation, and FIG. 2C illustrates a third cleaning composition formulation. In the present invention, the cleaning composition may comprise of a first cleaning composition formulation 200 having a variety of solvents and chemical agents efficacious for removing residue from a surface. In some embodiments, the cleaning composition may include an organic solvent 202 for helping to dissolve the residue. The organic solvent may include, without limitation, vegetable oil, palm oil, soybean oil, coconut oil, canola oil, and triglycerides.

In one embodiment of the present invention, the cleaning composition may comprise at least one co-solvent 204, including, without limitation, propylene carbonate, di-methyl carbonate, ethyl carbonate, methyl-ethyl carbonate, butyrolactone, ethyl lactate, di-methyl adipate, methyl-ethyl ketone, butyrolactone, and butenodiol. The formulation of the cleaning composition may further include a relatively large percentage of water 206 for providing fluidity and dissolving capabilities. Those skilled in the art, in light of the present teachings, will recognize that the at least one co-solvent in the cleaning composition occur naturally in nature and are safe to use in small concentrations.

In one embodiment of the present invention, the cleaning composition may include at least one water-in-oil emulsifier 208, including, without limitation, sorbitan stearate, polyglyceral oleate, lecithin, sorbitan monooleate, glyceryl monooleate, lanolin, dipropylene glycol methyl ether, dipropylene glycol, polysorbate 60, lanolin, octyldodecnnol, octoyldodecyl xyloside, peg-30 dipolyhydroxystearate, or any ehtoxylated fatty alcohol. The emulsifier may include a water-in-oil type emulsifier, whereby the water disperses into an oil phase. In some embodiments, the water-in-oil emulsion may contain nycelles of water and water soluble components surrounded by lipophilic solvents and oil. The nycelles may allows for diluted solvents to form a concentrated film of lipophilic solvent on the surface for enhanced cleaning capabilities. In contrast, an oil-in-water emulsion may not provide the same cleaning capabilities. For example, without limitation, nonyl phenol ethoxylate, sorbitan mono-stearate, and polysorbate 20 are oil-in-water emulsifiers 220 that may not function properly in the cleaning composition because upon shear mixing and emulsification, water and its dissolved components may become encapsulated in the oil as the nycelles, thereby restricting engagement with the surface. Conversely, the water-in-oil emulsifier may form a thin film to form from the oil and its dissolved solvent components for directly engaging with a substrate. The water and detergent may then become available to remove the solvent and residue from the substrate when rinsed with water or wiped with a towel. However, in some embodiments, a small percentage of the oil-in-water emulsifier may be added to the formulation of the cleaning composition. Those skilled in the art, in light of the present teachings, will recognize that when rinsed with water, polar water molecules may break down the water in oil nycelles to release the cleaning composition. This type of formulation may increase the effectiveness of the solvents while minimizing the amount of costly solvent needed to be effective. In one embodiment, the emulsifier di-propylene glycol mono-methyl ether may include a non-toxic carrier agent composed to amplify the solvent properties of the at least one co-solvent. The di-propylene glycol mono-methyl ether may also provide enhanced emulsification and provide long term stability to the emulsion even when frozen and thawed by inhibiting the formation of large water crystals.

In one embodiment of the present invention, the water-in-oil emulsifier, di-propylene glycol mono methyl ether may dissolve residue such as, dried acrylic and urethane resins, while not it does not rapidly dissolve epoxy or alkyd paints. Nonetheless, the di-propylene glycol mono methyl ether may wet and soak into the surface, increasing porosity, while acting as a carrier agent. The carrier agent function may allow the di-propylene glycol mono methyl ether to carry non-polar lipophilic solvent into layers of hardened resin comprised of polar monomer molecules. Those skilled in the art, in light of the present teachings, will recognize that combining lipohphilic solvents with low dipole moments less than one, such as, but not limited to, vegetable oil comprised mostly of triglycerides, methyl carbonate, ethyl-methyl carbonate, ethyl carbonate, or esters of an alcohol and carboxylic acids, with a solvent that is miscible in both non-polar and polar liquids such as, but not limited to, oil and water, may dissolve cured epoxy and cyanoacrylate resins that contain monomers having both polar and non-polar constituents. In some embodiments, the glycol ether may serve as a non-ionic surfactant and emulsifier, reducing the number of required ingredients. In some embodiments, the at least one co-solvent may be miscible in both oil and water. The miscible solvents may include, without limitation, propylene carbonate, butenediol, acetone, and gamma butyrolactone. The butenediol and gamma butyro-lactone may be controlled substances that when used in an appropriate fashion may be exempt from government regulation.

In one embodiment of the present invention, the cleaning composition may include thickening agents for lowering the volatility and vapor pressure of the solvents. In some embodiments, water phase of the cleaning composition may be thickened with a water phase thickening agent 210. In this manner, the cleaning composition may be mixed at room temperature, thereby reducing manufacturing costs. The water phase thickening agent may include, without limitation, guar gum, carageenan gum, xanthan gum, and bentonite clay. Those skilled in the art, in light of the present teachings, will recognize that thickening agents may require large quantities of heat during the shear mixing manufacturing process. The additional heat may add complexity and additional safety measures when working with volatile solvents. The guar gum may serve to help lower the volatility and vapor pressure of the solvents, thereby helping to negate the need for the heat during the manufacturing process. The cleaning composition may include an oil phase thickening agent 211, including, without limitation, bentonite clay for increasing viscosity of the organic solvent and the at least one co-solvent in the oil phase. Those skilled in the art, in light of the present teachings, will recognize that thickening agents may include a shear thinning property such that when used to gel the cleaning composition, the resulting gel composition may have a thixotropic property and may decrease in viscosity in the presence of shear forces and later gel in the absence of shear forces. In this manner, the cleaning composition may more easily flow from a dispenser under force or blend easily into solution while shear mixing and gelling, thereby helping to simplify the mixing, dispensing, and pouring process during manufacture. In some embodiments, an anionic agent 212, including, without limitation, ammonium xylene sulphonate may be added to disperse the cleaning composition and enhance sudsing. In this manner, the cleaning agent may be rinsed from the hands with water. In yet another embodiment, a saturated fatty acid 214, including, without limitation, lauric acid may be added to the cleaning agent, serving as a In some embodiments, an abrasive 216, such as walnut shells may be included for enhancing the cleaning process. Additional ancillary ingredients used to compose the cleaning composition may include a denaturant 218, including, without limitation, denatonium for providing a bitter taste to the composition, thereby helping to prevent accidental ingestion. In some embodiments, an anti-oxidant 222 may be added to further extend the shelf life of the product, including, without limitation, BHT, reducing agents, thiols, ascorbic acid, and polyphenols.

In one embodiment of the present invention, a second cleaning composition formulation 224 may include a variety of solvents and chemical agents that differ from the first cleaning composition formulation. The second formulation is equally as effective however may use a different co-solvent that is not a carbonate ester. The second cleaning composition formulation may include a greater percentage composition of water, and a smaller percentage composition of the at least one co-solvent. The second cleaning composition formulation may further include less water-in-oil emulsifiers.

In one embodiment of the present invention, a third cleaning composition singularly uses propylene carbonate as a co-solvent with vegetable oil and proves equally effective as the first and second formulations at removing hardened epoxy, cyanoacrylate adhesive and sticky tar from a substrate.

In some embodiments, the cleaning composition may include different concentrations and amounts of solvents and chemical agents. For example, without limitation, the cleaning composition may comprise about 20%-60% water, about 10-50% of vegetable oil or glycerol esters of plant or animal derived fatty acids, about 2-20% carbonate ester of aliphatic alcohol or alcohols, a water-in-oil emulsifier, and non-ionic and anionic surfactant, such as, but not limited to, a salt of an aromatic sulphonate i.e. ammonium xylene sulphonate. A further example may include, without limitation, about 20%-60% water, about 10-50% of vegetable oil or glycerol esters of plant or animal derived fatty acids, a lipophilic solvent, a solvent that is miscible in both oil and water, a water-in-oil emulsifier, a non-ionic and a anionic surfactant, such as, but not limited to, a salt of an aromatic sulphonate i.e. ammonium xylene sulphonate.

In one embodiment of the present invention, the solvents and chemical agents may be combined by blending the solvents and chemical agents, except the anionic surfactant or ammonium xylene sulphonate and a portion of the water, at high speed for 15 minutes at room temperature. The duration of the high speed mixing process may be reduced by mixing at a temperature greater than 75 degrees C. The mixing speed may then be lowered and the anionic surfactant pre-blended with the remaining portion of the water may be added and allowed to mix for another 3 minutes. The cleaning composition blend may then be ready for dispensation.

In one embodiment of the present invention, the process of at least partially removing residue from the surface may include adding residue to a hand, applying the cleaning composition to the hand, and finally engaging the hand with the cleaning composition until clean. For example, without limitation, applying 0.3 ml of 5 epoxy and 6 drops of methyl acrylate, super glue, and latex paint to separate areas of the palm of the hand. Pressure may then be applied to the super glue with a teflon sheet until the super glue sets. The teflon sheet may then be removed. In some embodiments, waiting about 40 minutes to make sure that the super glue, epoxy, and paint have hardened. Adding 1 teaspoon of used motor oil tar from a scrapped automotive oil pan, and spreading on the hands with a spatula and roofing tar. Applying 2 table spoons of formulation 1 to the hands and rubbing in for about 5 seconds, and then wiping with a rag. In some embodiments, the hand may become completely clean with no sign of residue. The above process may be repeated with the exception that the hand may be rinsed with water instead of wiped with a rag. In one alternative embodiment, the cleaning composition may be sprayed onto the surface with a sudsing agent, whereby scrubbing may not be necessary. In yet another alternative embodiment, the cleaning composition may not include the vegetable oil, serving solely as a paint remover.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a cleaning composition that combines a vegetable oil with small concentrations of co-solvents according to the present invention will be apparent to those skilled in the art. Various aspects of the invention have been described above by way of illustration, and the specific embodiments disclosed are not intended to limit the invention to the particular forms disclosed. The particular implementation of the cleaning composition that combines a vegetable oil with small concentrations of co-solvents may vary depending upon the particular context or application. By way of example, and not limitation, the cleaning composition that combines a vegetable oil with small concentrations of co-solvents described in the foregoing were principally directed to cleaning agents that remove paints, epoxies, and grease simultaneously implementations; however, similar techniques may instead be applied to cleaning agents inside engines for cleaning fuel systems, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A cleaning composition comprising:

a) between about 10% to about 50% of at least one organic solvent comprising vegetable oil;

b) between about 2% to about 20% of at least one co-solvent, wherein said co-solvent comprises propylene carbonate;

c) at least one water-in-oil emulsifier wherein said water-in-oil emulsifier comprises dipropylene glycol mono methyl ether;

d) non-ionic surfactant;

e) at least one anionic surfactant; and f) between about 20% to about 60% of water.

2. The cleaning composition as recited in claim 1, further comprising at least one additive selected from the group consisting of an anti-microbial, an anti-oxidant, a chelating agent and a pH balancing agent.

3. The cleaning composition as recited in claim 2, wherein said pH balancing agent comprises a saturated fatty acid.

4. The cleaning composition as recited in claim 1, further comprising at least one denaturant.

5. The cleaning composition as recited in claim 4, in which said denaturant comprises denatonium benzoate.

6. The cleaning composition as recited in claim 1, in which said anionic surfactant comprises ammonium xylene sulphonate.

7. The cleaning composition as recited in claim 1, further comprising at least one oil-in-water emulsifier.

8. The cleaning composition as recited in claim 7, in which said oil-in-water emulsifier comprises nonyl phenol ethoxylate.

9. The cleaning composition as recited in claim 1, further comprising at least one water phase thickening agent.

10. The cleaning composition as recited in claim 9, in which said water phase thickening agent comprises guar gum.

11. The cleaning composition as recited in claim 1, further comprising at least one oil phase thickening agent.

12. The cleaning composition as recited in claim 11, in which said oil phase thickening agent comprises bentonite clay.

13. A cleaning composition comprising:

a) between about 10% to about 50% of at least one organic solvent comprising vegetable oil;

b) between about 2% to about 20% of at least one co-solvent, wherein said co-solvent comprises propylene carbonate, a lipophilic co-solvent that is miscible in both oil and water and mixtures thereof;

c) at least one water-in-oil emulsifier wherein said water-in-oil emulsifier comprises a glycol methyl ether;

d) a non-ionic surfactant;

e) at least one anionic surfactant comprising at least ammonium xylene sulfonate as a sudsing agent;

f) between about 20% to about 60% of water;

g) at least one additive selected from the group consisting of an anti-microbial, a chelating agent and lauric acid as a pH balancing agent;

h) denatonium benzoate as a denaturant;

i) at least one water phase thickening agent comprising guar gum;

j) at least one oil phase thickening agent comprising bentonite clay;

k) at least one abrasive comprising walnut shells; and l) at least one anti-oxidant comprising BHT.

14. The cleaning composition according to present claim 1, wherein the at least one co-solvent further comprises butyrolactone as an additional co-solvent.

* * * * *